United States Patent [19]

Offeringa

[11] 4,040,483

[45] Aug. 9, 1977

[54] RECOVERY OF OIL BY CIRCULATING HOT FLUID THROUGH A GAS-FILLED PORTION OF A NETWORK INTERCONNECTED FRACTURES

[75] Inventor: Jan Offeringa, Rijswijk, Netherlands

[73] Assignee: Shell Oil Company, Houston, Tex.

[21] Appl. No.: 647,947

[22] Filed: Jan. 9, 1976

Related U.S. Application Data

[63] Continuation-in-part of Ser. No. 571,463, April 25, 1975, abandoned, and Ser. No. 586,106, June 11, 1975, abandoned.

[30] Foreign Application Priority Data

| | | |
|---|---|---|
| June 4, 1974 | United Kingdom | 24681/74 |
| Mar. 14, 1975 | United Kingdom | 10730/75 |

[51] Int. Cl.[2] ..... E21B 43/25

[52] U.S. Cl. ..... 166/272; 166/303

[58] Field of Search ..... 166/272, 303, 306

[56] References Cited

U.S. PATENT DOCUMENTS

| | | | |
|---|---|---|---|
| 1,816,260 | 7/1931 | Lee | 166/306 |
| 2,881,838 | 4/1959 | Morse et al. | 166/306 |
| 3,126,961 | 3/1964 | Craig et al. | 166/306 |
| 3,358,759 | 12/1967 | Parker | 166/303 |
| 3,386,508 | 6/1968 | Bielstein et al. | 166/272 |
| 3,493,049 | 2/1970 | Matthews et al. | 166/272 |
| 3,814,186 | 6/1974 | Allen | 166/303 |

*Primary Examiner*—Ernest R. Purser

[57] ABSTRACT

The recovery of oil from an oil-bearing formation which contains a network of interconnected fractures is improved by circulating a hot heat-exchanging fluid through gas-containing portions of the fractures while producing oil from liquid-containing portions of the fractures.

10 Claims, 5 Drawing Figures

RECOVERY OF OIL BY CIRCULATING HOT FLUID THROUGH A GAS-FILLED PORTION OF A NETWORK INTERCONNECTED FRACTURES

CROSS REFERENCE TO RELATED PATENT APPLICATION

This application is a continuation-in-part of applications Ser. No. 571,463 filed Apr. 25, 1975, and Ser. No. 586,106 filed June 11, 1975, both of which are now abandoned. The disclosures of those applications are incorporated herein by cross-reference.

BACKGROUND OF THE INVENTION

The invention relates to a process for increasing the amount of oil which can be recovered from an extensively fractured oil reservoir.

An extensively fractured oil reservoir is composed of relatively small, low permeability matrix blocks separated from each other by a network of interconnected fractures (which may be supplemented by solution channels, vugs and other cavities). In such reservoirs, some oil is often found within the fractures but most of the oil is present within the low permeability matrix blocks. Although secondary recovery processes are needed to increase the oil recovery, the conventional processes, such as waterflooding, gas injection or the like, are generally inapplicable in a highly fractured reservoir.

For example, a publication by S. J. Pirson, bulletin of the American Association of Petroleum geologist, Vol. 37, February 1953, page 232, discusses production problems of highly fractured reservoirs. It indicates that, in view of the tendency for the gravity segregation of fluids in the fracture network and capillary effects to trap oil within the matrix blocks, it is desirable to reduce the extent of gravity segregation by applying a high horizontal drive pressure gradient and as high as draw down (at the production well) as can be employed without undue water encroachment. Alternatively, it recommends selectively completing the wells for producing only from the lower zone (e.g., by plugging-off the upper zone) and using cyclic depressurizations followed by gradual depressurization during production cycles.

In publications by S. H. Raza, First Turkey Petroleum Congress, Ankara, Turkey, Dec. 14–16, 1970 proceedings, pages 27–133, November 1971, such production problems are further discussed. It mentions that, in addition to the unsuitability of waterflooding, gas injection and the like, a water-imbibition procedure is only applicable where the reservoir is strongly water-wet and then may provide only an unattractively low rate of production. If the reservoir is sealed to an extent such that fluids can be confined at relatively high pressures, a cyclic pressure pulsing process can be used.

In a cyclic pressure pulsing process one or two water pressure cycles procede at least one gas pressure cycle or a series of alternating gas and water pulsing cycles. In such processes, nitrogen, methane and carbon dioxide have been indicated to be equally effective where oil viscosity is relatively low, although the volume required for a pressurization with $CO_2$ is significantly greater. However, such pressuring and de-pressuring steps are relatively expensive unless the total oil-free fluid filled pore space of the reservoir is small enough that it can be refilled with relatively high pressurized gas in a relatively short time.

U.S. Pat. No. 3,653,438 describes a gravity-aided miscible-drive process that is particularly applicable to a viscous oil reservoir having a high and relatively uniform permeability. A oil-soluble gas such as carbon dioxide and/or a mixture of carbon dioxide and/or a mixture of carbon dioxide and liquid petroleum gas is injected at an upper level within the reservoir while a petroleum product comprising a mixture of oil and gas is produced at a lower level. Where the oil zone overlies an active aquifer, nitrogen or any low valued gas is preferably injected into the highest point within the reservoir to maintain an overall reservoir pressure that prevents or controls the water encroachment.

However, as indicated above, such previously proposed drive or drainage processes that involve the flowing of oil through a reservoir of relatively uniform permeability are not applicable to an extensively fractured reservoir. In such a fractured reservoir the permeability is very high in the fracture network but is very low within the oil-containing rock matrix. Drive fluids flow easily through the fracture network, but bypass the oil in the matrix blocks. In addition, because of the gravity segregation of the fluid within the fractures, any undissolved gas spreads quickly to the vicinity of any production location. Therefore, if a mixture of liquid and undissolved gas is produced while a hot or oil-soluble gas is being injected, the injected gas may be produced before it has heated the oil or been dissolved in the oil.

SUMMARY OF THE INVENTION

The present invention relates to increasing the amount of oil recovered from an extensively fractured reservoir in which liquid hydrocarbons are contained in matrix blocks of low permeability surrounded by a relatively highly permeable network of interconnected fractures. The reservoir is first treated by injecting or producing fluid to the extent necessary to form, within the fracture network, a substantially gas-filled gas layer that overlies a substantially liquid-filled liquid layer. Fluid is then injected so that hot fluid flows into the gas layer, heats oil contained in the matrix blocks, and causes heated oil to be displaced into the fracture network. An oil-containing liquid is produced from the liquid layer. And, the rates and locations of the injections and productions are correlated or adjusted to keep the interface between the gas and liquid layers at selected depths within the fracture network.

DESCRIPTION OF THE INVENTION

Figure 1:
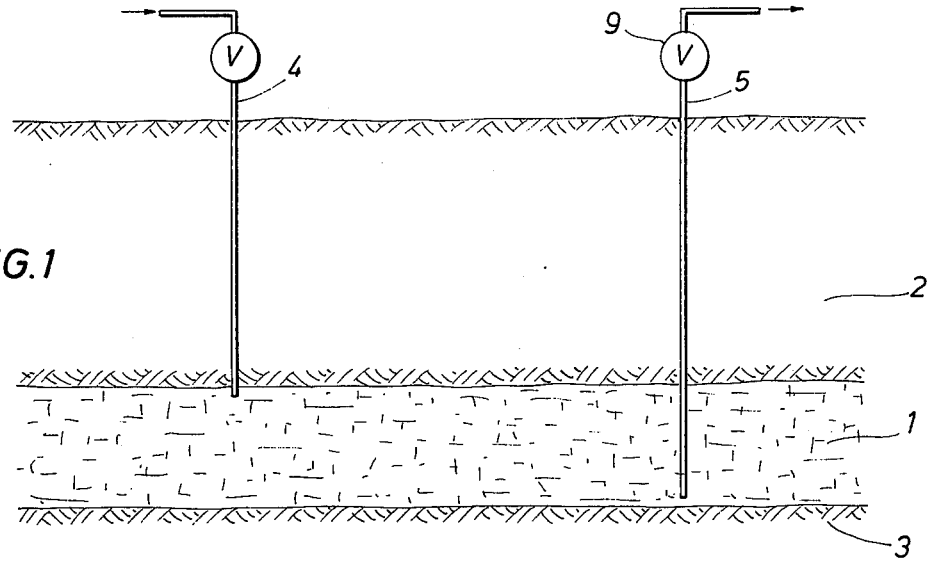
FIG. 1 schematically shows a section over a fractured limestone formation wherein the total volume of the natural fracture network contains oil.

The present invention is, at least in part, premised on the following discovery. When a gas layer is present within an extensively fractured reservoir, liquid hydrocarbons can be recovered at a suitable rate by flowing a hot fluid within the fracture network. In this way the tendency for fluids to flow freely and undergo gravity segregation within the network of fractures (which hindered production in prior processes) can be used as an advantage. When a hot fluid flows into the gas layer within the fracture network, it is relatively quickly distributed throughout the horizontal extent of the gas layer. This causes it to contact and heat the oil contained in many of the matrix blocks. The heating dissolution swells the oil, while reducing its interfacial tension and viscosity, and displaces the swollen oil into the fractures. Within the fractures the swollen oil is segregated into a location near the interface between the gas and liquid layers. From there a substantially gas-free liquid that contains the oil can readily be produced.

For example, by circulating a hot fluid through a gas-containing portion of a fracture network in an extensively fractured limestone formation portions of the limestone matrix blocks, primarily those situated above the gas/liquid interface in the fracture network, are subjected to an increase in temperature. This heats the oil that is trapped by capillary action in the limestone blocks. The vapor pressure of some of the components of the oil rises above the gas pressure in the fractures, and gas bubbles are formed. As the gas bubbles move through the pore spaces of the limestone blocks they displace oil into the fractures. The oil in the fractures can then be recovered via one or more production wells communicating with the liquid-containing zone of the fracture system. Such a heating also lowers the interfacial tension between the oil and gas, and thermally expands the oil. Both of these effects also increase the tendency for oil to flow out of the limestone blocks and into the fractures.

Where oil is trapped by capillary action in matrix blocks that are surrounded by liquid-containing portions of fractures of a network of fractures, the hog fluid circulation may also release oil from this lower region. The oil in the matrix blocks in this region tends to be heated by contact with the circulating heat-exchanging fluid and/or liquids that have been heated by or condensed from such a fluid.

It will be apparent that it is the specific nature of an extensively fractured formation that allows the efficient application of heat-exchanging fluids to increase the temperature of substantially all of the zones in which oil is trapped by capillary action. The network of intercommunicating fractures surrounds the matrix blocks and serves as low-resistance passageways through which the hot fluid can freely flow into contact with the oil-containing blocks. Since the oil recovery efficiency is improved by heating as much as possible of the oil-containing rock, the hot fluid is preferably circulated a relatively long distance through the fracture network. Thus, it is preferable to withdraw liquid or gaseous fluid from the fracture network at locations as far as possible from those at which hot fluid is injected into the fracture network. In general, the fractures in that network are so permeable that the pressure within the fracture network remains substantially uniform along uniform depths within the network. However, by changing the rates of injecting and producing fluids, or the like, temporary pressure differences may be established between various locations to promote a prompt distribution of the injected hot gas over the horizontal and vertical extension of the gas-containing part of the fracture network. Hot gas can be injected into the fracture network at relatively high or low rates without creating pressure differences that might cause gas breakthroughs into the recovery wells (communicating with the oil-containing part of the fracture network).

In general, the present invention is applicable to substantially any oil-containing extensively fractured reservoir in which (a) the permeability within the fracture-surrounded blocks of matrix rock is small enough to trap oil by capillary action, and (b) the permeability within the inter-connected fractures is high enough so that fluids undergo gravity segregation and the pressure gradients are less than the liquid heads over horizontal distances of significant extent. Reservoirs to which the present process is applicable can be either oil-wet or water-wet or a combination thereof. Although such highly fractured reservoirs can be either predominately siliceous or carbonaceous, they are often carbonaceous and are commonly referred to as highly fractured limestone formations. Such reservoirs are encountered in the Middle East oil fields, and in West Texas oil fields such as the Yates Field and the TXL Devonian Field. Although the fractures in an extensively fractured reservoir are usually natural fractures, they can be natural fractures supplemented by artificially induced fractures or can comprise a network of relatively closely spaced inter-connected artifically induced fractures such as those resulting from a nuclear detonation, a chemical explosive and/or a massive hydraulic fracturing operation, etc.

Figure 3:
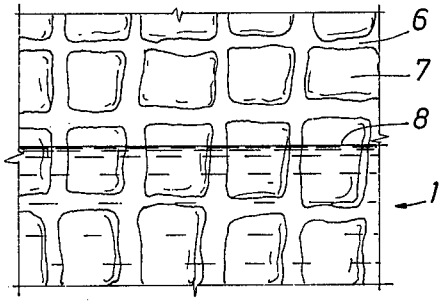
FIG. 3 schematically shows on a larger scale than FIG. 1 and 2 a detail of a limestone formation with natural fracture network.

Referring to the drawing, FIG. 1 shows an extensively fractured limestone formation 1 located between caprock 2 and base rock 3 and penetrated by wells 4 and 5. As shown in FIG. 3, formation 1 contains a plurality of relatively impermeable matrix blocks 7 surrounded by a network of interconnected relatively highly permeable fractures 6.

Figure 2:
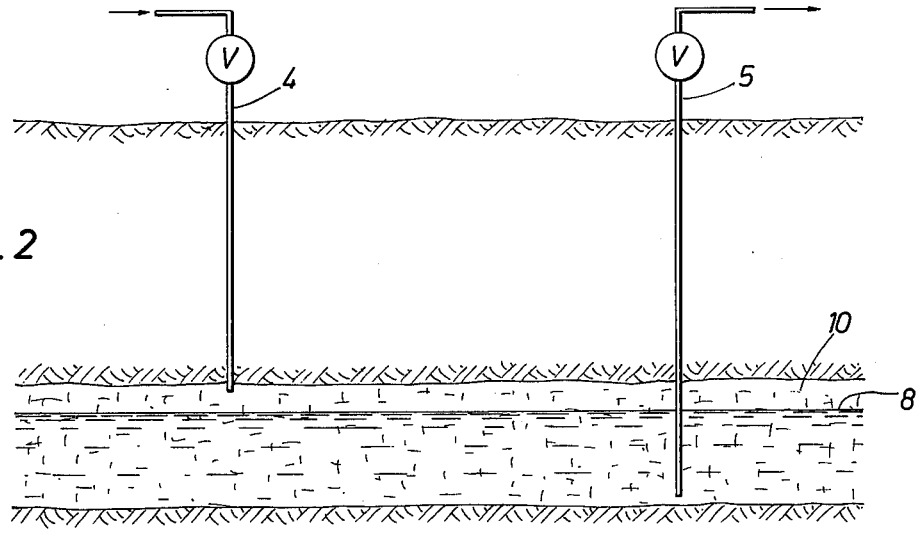
FIG. 2 schematically shows a section over the same formation as shown in FIG. 1, but at a later stage of the oil recovery operation.

The wells and well-completing equipment and techniques can comprise those currently available. As indicated in FIGS. 1 and 2 the injection wells are preferably opened into fluid communication with the reservoir formation within an upper portion of the reservoir while the production wells are opened into a lower portion of the reservoir. This is preferably accomplished by extending each well through the reservoir and cementing-in a casing string which is subsequently perforated at depths at which fluids are to be injected or produced. However, if desired, such wells can be perforated throughout the reservoir interval. In this case, since the wells communicate with the fracture network, within it, regardless of where gases are injected, they are promptly segregated to the top of the reservoir. The bottom of a production tubing string through which liquid is to be produced can be isolated from the upper portion of the well borehole that contains it with a packer or the like. Where such a packer is used it is perferably one which can be relocated to change the depth from which fluid is produced.

FIG. 1 illustrates the start of the present process in a reservoir in which substantially all of the pore space, in both matrix blocks 7 and fractures 6, is filled with a mixture of aqueous liquids and hydrocarbons (e.g., oil). In such a situation, within the fractures, the oil would tend to be located above the aqueous liquid, but within the pores of the matrix blocks, since the tendency toward gravity segregation is opposed by capillary action, the extent of segregation would be much less. Both oil and water will often be initially distributed nearly equally over most of the height of a matrix rock block located above the water level existing in the fractures.

In the first step of the present process, the reservoir is treated by injecting or producing fluid to the extent necessary to form, within the fracture network, a layer of gas that overlies a layer of liquid. Where the reservoir oil contains a significant proportion of dissolved gas and the reservoir fluid pressure is relatively high, such as gas layer can be formed by producing oil while either maintaining or reducing the reservoir pressure. Where the original reservoir pressure is to be maintained, gas can be injected through well 4 while liquid is produced through well 5, with substantially equal volumes of fluid being injected and produced. Where the reservoir pressure is to be reduced, the liquid is produced, with or without any gas injection, at a volumetric rate faster than that at which gas is injected. As shown in FIG. 2 a gas layer (or gas cap) can be formed, with a gas-liquid interface 8 existing between the gas and liquid layers within the fracture network. The depth of interface 8 is, of course, directly responsive to the relative rates of gas injection and liquid production. The depth location of the interface falls when the volume of liquid produced exceeds the volume of gas injected, etc.

Whether or what kind of gas should be injected in order to form such a gas layer is primarily an economic decision. If a gas is injected such a gas can be air, nitrogen, flue gas or other low-cost gas and/or carbon dioxide. Where desired, such a gas can be heated and/or can comprise a hot vapor such as steam. If the reservoir oil contains a high proportion of dissolved gas for which the current market is good, if desired, the solution gas can be produced while another gas is injected and liquid is produced so that the reservoir pressure is adjusted to or is kept at a selected value while both oil and gas are recovered for marketing during the forming of a gas layer within the fracture network. If the oil is significantly more valuable with its gas in solution, such an oil can be recovered from the produced liquid while gas is being injected, with the relative rates being adjusted to substantially maintain or, if desirable, to increase the pressure within the reservoir during the forming of the gas layer within the fracture network.

Where the reservoir oil viscosity is high enough and/or the oil mobility is low enough to impede the rate of fluid flow and/or gravity segregation of fluids within the fracture network, additional steps may be desirable prior to or during the formation of the gas cap within the fracture network. Conventional fluid drive and/or thermal drive procedures can be employed to recover the oil contained in the fractures and/or to reduce its viscosity or increase its mobility. In such a treatment, the drive is preferably conducted throughout the vertical extent of the reservoir. For example, this can be done by opening wells such as 4 and 5 throughout the total vertical interval of formation 1 and injecting a gaseous or liquid drive fluid through one while producing through the other so that most of the drive flows through the fracture network while bypassing the matrix blocks 7. In such a fracture-cleaning step, the circulated fluid can comprise an aqueous liquid of the type used in a waterflood, chemical flood, miscible drive, or the like. Or, the fracture-cleaning fluid can comprise light hyrocarbon fractions, LPG, or contain or form hot fluids that thermally mobilize the oil. During such a fracture-cleaning step, particularly where a pattern of wells is employed, the pressure differentials due to the pressure differences between the fluid injection pressures and production well drawdown pressures are preferably made as high as feasible in order to confine the zone that is swept by the fracture-cleaning fluid to those within the well pattern to be employed.

To reduce the amount of oil trapped in the limestone blocks situated above interface 8, in a preferred procedure, steam is injected into the gas-containing portions of fractures 6. The steam is injected via the well 4 from a suitable source (not shown) under a suitable pressure and at a suitable temperature.

The steam on entering the formation 1 flows through the gas-containing part of the fractures 6 and heats the blocks 7. The formation of gas bubbles and the concurrent thermal expansion and viscosity reduction within the oil all contribute to the expulsion of oil from the pore space of the blocks that are heated. The oil which is expelled from the blocks 7 above the oil/gas interface 8 flows downwards through the fractures 6 to this interface where it joins the volume of oil present below the interface. The oil within the fractures flows into well 5 and is removed.

Any condensate formed by cooling injected steam within the gas-filled part of the fracture system will flow downward toward the interface 8. Depending on the difference in density between the oil and the condensate, a water layer may be formed either on top of or below the oil within the fracture system. Part or all of this water may be recovered with the oil.

Since the density of a reservoir oil is usually less than that of an aqueous liquid, the oil within such a liquid layer tends to be concentrated just below the gas-liquid interface. Thus, the oil-containing liquid that is produced from the reservoir is perferably produced from near the top of the liquid layer. Such production can be intermittent or continuous. The point of the fluid withdrawal is preferably located such a distance below the gas-liquid interface as to maintain a relatively high oil-cut in the produced fluid as compared to water coning upward and gas coning downward into the oil layer and thus being produced together with crude oil.

In the present process, the rates and locations of the injections nd productions of fluid are correlated so that oil-containing liquid is produced and the gas-liquid interface remains at or is moved to selected depth locations within the fracture network. As known to those skilled in the art, in an extensively fractured reservoir, the magnitude of the oil saturation in the matrix blocks of the reservoir may vary with depth. If the reservoir has undergone a pressure decline, for example due to the receding of water and/or a lowering a temperature, or due to a long prior primary production period or the like, the gas cap may have existed for a significant time. In such a situation the extent to which gravity segregation has occurred within the matrix blocks is a function of the native viscosity and/or mobility of the oil, interfacial tension properties of the oil, the distance above or below the gas-liquid interface, etc.

In general, as the gas-liquid interface is lowered in the fracture network, some oil and/or water will drain out of the matrix rock into the fractures. Gas phase either invades the matrix rock to a limited extent, or pervades the rock by coming out of solution in the oil if the reservoir pressure is reduced below the bubble point pressure during this phase of the process. The gas saturation (volume fraction of the pore space) in the matrix rock will then, because of the capillary pressure gradient due to interfacial tension between gas and oil, be highest at the top of the matrix blocks and lowest near the liquid in the fractures. Thus, the oil saturation is least at the top of the blocks and is greatest at the oil level in the fractures.

Where the reservoir is substantially liquid-filled at the time the process is started, it is generally advantageous to control the rates and locations of fluid injections and productions so as to move the gas liquid-interface from substantially the top to the bottom of the reservoir while circulating enough hot fluid through the gas cap to heat a significant proportion of the oil present in the matrix blocks. The depths from which the substantially gas-free liquid is produced are preferably adjusted to the extents required to keep them near the top of the liquid layer within the fracture network. The rates of fluid injections and productions are preferably arranged to maintain a relatively high pressure throughout substantially the total production operation, so that gaseous and liquid hydrocarbons can be recovered during a final blow-down production phase involving a gradual depressuring of the reservoir.

The gas cap 10 is preferably relatively small at the time the injection of steam is initiated. This ensures that the steam will be distributed relatively uniformly over the production area from which oil is drained via the well 5. Continuous supply of steam through the well 4 will allow a rise in temperature of the blocks that are gradually emerging from the downwards receding oil/-gas interface 8.

The pressure of the gas in the gas cap 10 may be controlled in any suitable manner. If desired, the pressure in the gas-containing fractures may be increased by increasing the injection rate of the steam via the well 4. Also, gas present in the cap 10 may be drained, in order to lower the pressure in the gas cap, or to promote an efficient distribution of the hot gas over the area that is producing via the well 5, or the like. Such a production of gas may take place through one or more wells (not shown) situated at some distance from the well 4 and communicating with the gas cap 10. For example, such gas-drainage well could be situated near the location of the well 5. Although this will cause a steam flow in well 5, it will not enhance the flow rate through the oil-containing part of the fracture network 6. The high permeability of the fracture network obviates the creation of large pressure differences between the injection and production locations within the gas-containing fractures of the network (which would be required to enhance the rate of the oil flow). In such a gas-production operation the outflow should be throttled to maintain a selected pressure within the gas cap.

The gas drained from the gas cap may be used for several purposes. If desired, any steam included in this gas may be separated therefrom and re-injected (preferably after reheating) via well 4 or another well communicating with the gas cap at some distant location from the drainage location. Prior to re-injection, the steam may be mixed with other gas or other gases.

If desired, the transport of oil through the well 5 may be assisted in particular in the latter stages of the operation, by the use of pumps (not shown) in well 5.

The steam applied as a heat-exchanging fluid in the present method may be generated in any one of the known manners. The steam may either be wet or dry (such as superheated). If desired, additional gases may be mixed with the steam prior to injecting the steam into the fractures of the limestone formation.

Figure 4:
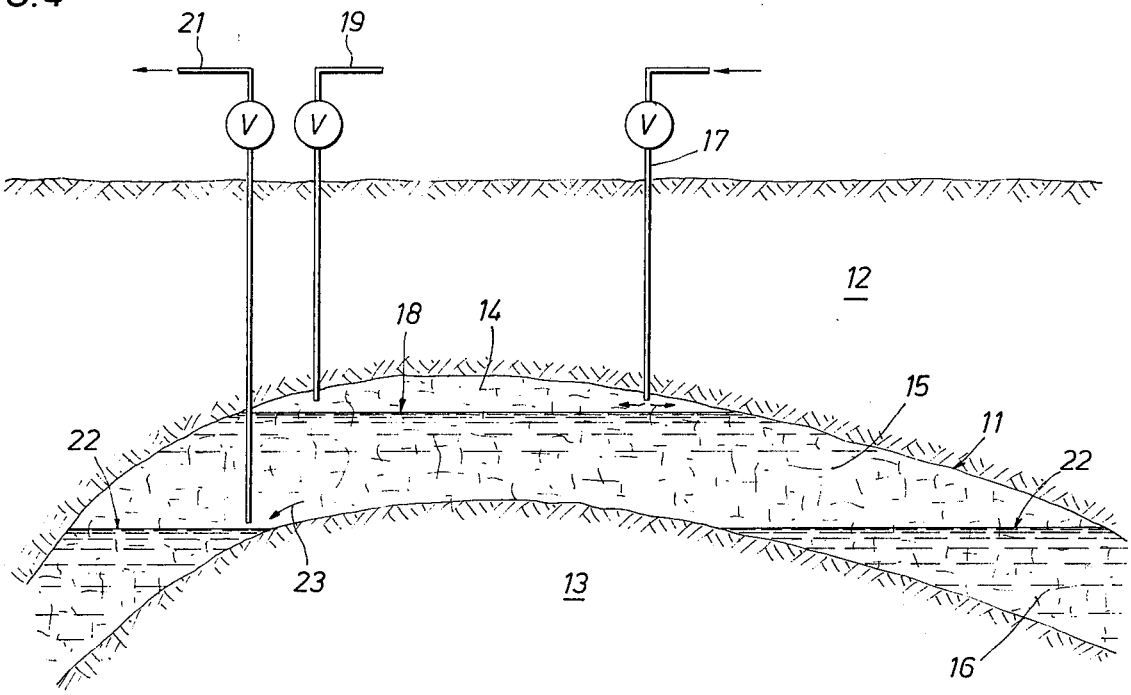
FIG. 4 schematically shows a section over a fractured limestone formation with natural fracture network, which formation comprises a gas cap.
Figure 5:
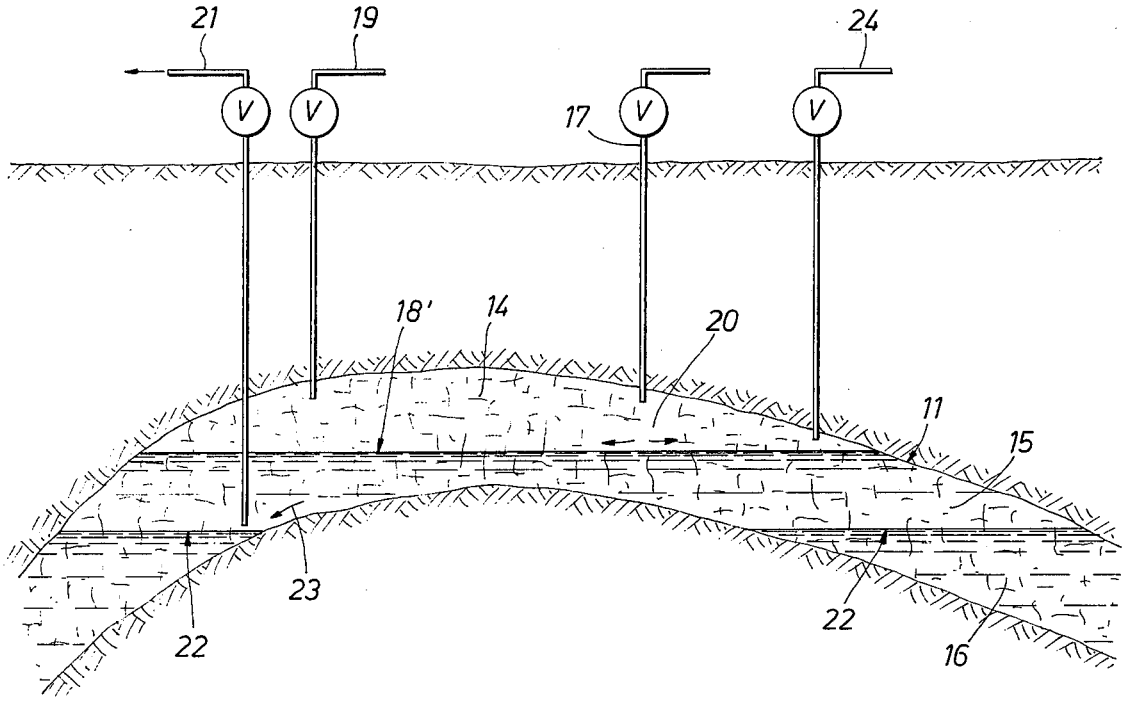
FIG. 5 schematically shows a section over the same formation shown in FIG. 4, but at a later stage of the oil recovery operation.

In the example shown in FIGS. 4 and 5 of the drawing, the fractured limestone formation 11 is located between impermeable cap rock 12 and an impermeable base rock 13. It is observed that the formation 11 is of the same type as the formation 1 shown in FIG. 3. The space of formation 11 not filled with limestone is occupied by hydrocarbon gas collected in gas cap 14, by oil collected in zone 15 below the gas cap 14, and by water collected in zone 16 below the oil zone 15. Gas cap 14 is filled with hydrocarbon gas.

Well 17 penetrates the formation 11 and communicates with the fractures of formation 11 at a level above the gas/oil interface 18. Well 17 is used for the introduction of gas into formation 11. The distribution of this gas over the gas cap 14 is promoted by the drainage of gaseous fluids, such as hydrocarbon gas, from the gas cap 14 via the well 19 which communicates with the gas-containing fractures in the gas cap 14.

Well 21 penetrates the formation 11 and communicates with the fractures of the formation 11 at a level which is relatively low in the oil zone 14. The opening into well 21 is sufficiently far from the water/oil interface 22 to prevent entrainment of water from the water zone 16 with the oil recovered via the well 21 (vide arrow 23).

In employing the present process in a fractured limestone formation arranged as shown in FIGS. 4 and 5, the water/oil interface 22 is preferably maintained at its original level by adjusting the pressure within the gas cap 14. While recovering oil via the well 21, oil-containing fractures which were originally just below the gas-/oil interface 18 will become filled with hydrocarbon gas. This leaves oil in the pore space of the permeable blocks that have emerged from the oil zone 15 as a result of the downwards receding level of the gas/oil interface 18 (see position 18' in FIG. 5).

The oil-bearing formation situated above the gas/oil interface can be heated by an underground combustion. Oxygen-containing gas (such as air) is supplied through the well 17 to the gas-filled part of the fracture system of formation 11. The injection of oxygen-containing gas is preferably preceded by heating the oil in or around the injection well to at least a near combustion level. The preheating can be conducted by operating a heater in the borehole, injecting steam or other hot gas, or the like. The hot gas produced by the combustion that occurs when the oxygen-containing gas is injected, flows through the gas-filled fractures of the gas cap 14 and heats the oil-bearing blocks 7. This causes the displacement of oil into the fractures in the manner described above.

To promote the distribution of the hot combustion gas over the gas cap, the venting well 19 is opened. When the gas cap 14 expands, new wells (such as well 24) may be drilled at locations distant from the existing air injection well(s) and gas-venting well(s). The new wells may be used either for the injection of combustion-supporting gas or for venting gas from the gas cap. They are preferably completed in communication with the fractures in the gas cap at locations which would otherwise not be contacted by the flow of hot combustion gas.

Where an oxygen-containing gas is to be injected to generate heat by an underground combustion, but the calorific value of the hydrocarbon gas and/or exposed oil present in the gas cap of the fractured limestone formation is too low to generate enough heat, a high calorific fuel may be injected. For example, such a fuel may be supplied to the formation either through the same wells (but through separate conduits) used for the supply of air to the formation, or through wells separate thereof. The oxygen-containing gas may be injected at a level below the gas/oil interface in the fracture network, where it may react with the oil present in the fracture network. When interface has descended to a level below the level of injecting the combustion-combustion supporting gas that gas will either react with the hydrocarbon gases present in the fracture network or with the oil in or on the limestone blocks. It will be appreciated that provided the well outlet is not too far below the gas/oil interface, the combustion gases such as those created by a reaction of air and oil can easily flow into the gas-filled part of the fracture system.

If the density of the oil is less than the density of water, the water condensing from steam that is injected or formed by a combustion process in the fracture system, will trickle down along the blocks and pass through the oil-filled part of the fracture system (such as oil zone 15 in FIG. 5) and finally be collected in the water zone 16. Any undesired rise in level of the oil/water interface 22 may be counteracted by increasing the pressure in the gas zone 14.

In an alternative embodiment of the invention, hot water may be used as a heat-exchanging fluid adapted for heating the limestone blocks surrounded by the gas-containing part of the fracture network. To this end, hot water supply wells are drilled to penetrate the fractured limestone formation. Such wells preferably communicate with the gas-containing part of the fracture network at a level above the uppermost blocks containing trapped oil. The hot water injected through these wells will flow down under influence of gravity along the outside of the blocks, thereby heating these blocks and promoting the expulsion of oil therefrom. The water and the expulsed oil will flow down into the oil-containing part of the fracture network and be recovered via wells communicating with this part of the fracture network.

When applying the present method in a formation of extremely large lateral dimensions, the horizontal area of the formation may be subdivided in a number of smaller areas that are treated by the present method in stages. This is particularly attractive in a formation containing a large gas cap in which great amounts of oil have been trapped by capillary action in the limestone blocks thereof. Heat that is retained in a depleted sub-area may be displaced to another sub-area by passing a heat-exchanging fluid consecutively through the two areas.

The present invention can be applied in a fractured limestone formation that has been depleted to an extent such that no oil (or hardly any oil) is left in the fractures. Hot heat-exchanging fluid is circulated through the network of fractures of which at least the major part contains hydrocarbon gas. If desired, at least part of the hydrocarbon gas is recovered via one or more gas production wells. Some or all of the hyrocarbon gas produced via these wells may be re-injected into the fractures. Alternatively, part of this gas employed as a source of the energy required for generating the heat-exchanging gas. By circulating hot heat-exchanging fluid through the fracture network, at least part of the oil trapped by capillary action in the pore space of the limestone blocks will be freed. This oil will flow out of the pore space of the blocks and be collected in the lower part of the fracture network. After a sufficient amount of oil has been collected, production of this oil may start. During production of oil, the circulation of heat-exchanging fluids through the gas-containing fractures may continue (either continuously or intermittently). Finally, a situation will be created similar to the one shown in FIG. 4. From then on, the recovery of oil may take place in the manner as described with reference to FIG. 4.

The application of the present invention is not restricted to fractured limestone formations having the configurations shown in the drawing. Any number of injection wells, oil recovery wells and gas-draining wells may be used, and may be arranged according to any pattern suitable for the purpose.

In the present process the recovery technique applied for recovering the oil from the oil-containing part of the fracture network may use natural forces, such as the natural gas pressure in the gas cap of the formation, to transport the oil out of the fracture network into a recovery well and subsequently through such well to the surface of the earth. If desired or required, this transport may be assisted by the action of pumps located in the recovery wells. The thermal energy of the heat-exchanging fluids is mainly used for freely oil trapped in the limestone blocks, particularly those which have emerged from a downward receding oil/gas interface in the fracture network. However, in manner known per se, use may be made of the compressional energy that is available in a hot heat-exchanging gas which is injected into the gas cap. For example, such energy can be used to increase the pressure in the gas cap either for lowering the level of the oil/water intersurface in the fracture network and/or for assisting in pushing the oil in the oil-containing part of the fracture network into the recovery wells and upwards through these wells to the surface of the earth.

What is claimed is:

1. In a process for producing oil from an extensively fractured reservoir in which oil is contained in matrix blocks of relatively low permeability which are surrounded by a network of interconnected fractures of relatively high permeability, the improvement comprising:

treating the reservoir by injecting or producing fluid to the extent necessary to form within the fracture network a substantially gas-filled gas layer overlying a substantially liquid-filled liquid layer;

injecting fluid which comprises or forms a hot fluid in a manner such that hot fluid flows into the gas layer, flows along the exposed faces of the matrix blocks, heats oil contained in the matrix blocks, and causes heated oil to be displaced into the fracture network;

producing an oil-containing liquid from within the liquid layer in the fracture network; and correlating the rates and locations of the injections and productions of fluid so that the interface between the gas and liquid layers in the fracture network is kept at selected depths within the network of fractures.

2. The process of claim 1 in which the reservoir is initially substantially completely liquid filled and the interface between the gas and the liquid layers is moved from substantially the top to the bottom of the reservoir.

3. The process of claim 1 in which the initial viscosity of the reservoir oil is relatively high and, prior to said formation of a substantially gas-filled layer, oil-displacing fluid is circulated through the fractured network to increase the permeability of that network.

4. The process of claim 1 in which the total average rates of fluid injections and productions are correlated to maintain the pressure of the reservoir at a selected relatively high value.

5. A process for producing oil which comprises:

establishing fluid communication with a subterranean reservoir formation in which oil is contained within fracture-surrounded blocks having a matrix permeability low enough to trap oil by capillary action and the fractures surrounding the blocks form a network of innerconnected fractures having a permeability high enough that fluids within the fractures undergo gravity segregation;

treating said reservoir formation by injecting or producing fluid to the extent necessary to form a gas layer overlying a liquid layer within the fracture network;

injecting fluid that comprises or forms a hot fluid so that hot fluid flows into the gas layer, flows along the exposed faces of the matrix blocks, heats oil contained in the matrix blocks, and causes heated oil to be displaced into the fracture network;

producing oil-containing liquid from within the liquid layer in the fracture network; and adjusting the rates and locations of the injections and productions of fluid so that the interface between the gas and the liquid layers in the network of fractures is kept at selected depths within the network of fractures.

6. The process of claim 5 in which steam is injected during the formation of the gas layer within the fracture network.

7. The process of claim 5 in which liquid is produced faster than fluid is injected during the formation of the gas layer in the fracture network so that at least a portion of the gas in that layer is hydrocarbon gas released from the reservoir oil.

8. The process of claim 5 in which the reservoir oil viscosity is relatively high and, prior to the forming of the gas layer within the fracture network, an oil-displacing fluid is circulated through at least a portion of the fracture network to cause an increase in permeability by a removal of relatively viscous fluid.

9. The process of claim 5 in which the injected fluid which comprises or forms a hot fluid consists essentially of steam or steam mixed with a lesser volumetric proportion of hydrocarbon gas.

10. The process of claim 9 in which the injected fluid which comprises or forms a hot fluid is injected at a pressure of at least about 1,000 psi and the rates of the injections and productions of fluid are adjusted to maintain a pressure of at least 1,000 psi within the fracture network throughout the production of a significant proportion of oil.

* * * * *